United States Patent [19]

Flagg et al.

[11] 4,326,945

[45] Apr. 27, 1982

[54] COAL LIQUEFACTION PROCESS

[75] Inventors: John F. Flagg, East Sandwich, Mass.; Russell W. Johnson, Villa Park; John G. Gatsis, Des Plaines, both of Ill.

[73] Assignee: UOP Inc., Des Plaines, Ill.

[21] Appl. No.: 195,047

[22] Filed: Oct. 8, 1980

[51] Int. Cl.[3] ..... C10G 1/00

[52] U.S. Cl. ..... 208/8 LE; 208/8 R

[58] Field of Search ..... 208/8 R, 8 LE

[56] References Cited

U.S. PATENT DOCUMENTS

| | | | |
|---|---|---|---|
| 3,503,865 | 3/1970 | Stone | 208/8 LE X |
| 4,076,607 | 2/1978 | Zavitsanos et al. | 201/17 X |
| 4,118,282 | 10/1978 | Wallace | 208/8 R X |

FOREIGN PATENT DOCUMENTS

| | | |
|---|---|---|
| 552983 | 6/1932 | Fed. Rep. of Germany . |
| 696610 | 6/1930 | France . |
| 357206 | 5/1930 | United Kingdom . |

OTHER PUBLICATIONS

English Translation of German 2,427,031 cited in U.S. Pat. 4,135,579, Troszt, Dec. 1975.

Solar System Astrophysics Brandt et al., McGraw Hill, N.Y., 1964.

Conversion of Coal into Liquids, U. of Utah, May 1970, Contract No. 14-01-0001-271, Final Report.

*Primary Examiner*—Delbert E. Gantz

*Assistant Examiner*—William G. Wright

*Attorney, Agent, or Firm*—James R. Hoatson, Jr.; John G. Cutts, Jr.; William H. Page, II

[57] ABSTRACT

A process for liquefying coal by subjecting bituminous coal particles to electromagnetic wave energy and having wavelengths of from about 0.001 to about 100 Å and recovering valuable liquid hydrocarbon products from the resulting liquid coal extract.

16 Claims, No Drawings

COAL LIQUEFACTION PROCESS

BACKGROUND OF THE INVENTION

This invention relates to a process for liquefying coal using electromagnetic wave energy defined as having wavelengths of from about 0.001 to about 100 Å. Typical sources of such electromagnetic waves are the x-ray tube and $\gamma$ rays of radioactive substances. It particularly relates to a process for liquefying coal using a selective solvent and subjecting the solvent-coal mixture to x-ray energy or $\gamma$ rays.

It has long been known that hydrocarbon gases, liquids, pitch, and chemicals may be obtained in useful form from coal which is mined from the earth. Usually, the prior art has employed destructive distillation or other gasification processes for the conversion of coal into valuable liquid hydrocarbon products. Recently, the prior art has developed a high pressure hydrogenation of coal technique to effectuate such conversion. Still more recently, methods involving solvent extraction techniques have been developed for obtaining useful fuels and chemicals from coal whereby the coal is contacted with a selective solvent which acts as a hydrogen-donor for supplying sufficient hydrogen to the coal to aid in converting it into a liquid state.

Following the solvent extraction step, the prior art schemes have utilized various recovery procedures, such as hydrogenation of the liquid coal extract for increasing its value and utility together with retorting or coking of the residual materials obtained from the solvent extraction step to still further convert these coal derived products into more commercially valuable products.

However, the aforementioned prior art procedures have not been substantially commercially attractive or feasible to warrent widespread commercial exploitation of converting coal into valuable normally liquid products. Generally, the deficiencies in the prior art schemes have not only involved capital investment problems and disposal problems of the residue or waste frequently having high metals content, but have also involved liquid product quantity and quality problems which have yet to be solved in an economical and facile manner.

In U.S. Pat. No. 3,503,865, the prior art has taught the use of microwave energy in the conversion of coal into liquid hydrocarbon products.

We have discovered that electromagnetic waves having wavelengths of from about 0.001 to about 100 Å, and in particular x-rays, are useful for the conversion of coal into valuable hydrocarbon products.

The radiation of Athabasca tar sands, aromatic hydrocarbons, waste water, petroleum oil, petroleum bitumen, kerosene and petrochemicals is known.

Since it is clear to those skilled in the art that the vast mineral resources of bituminous coal represent an extremely important supply of energy and an extremely important source of raw materials for valuable chemicals, it would be desirable to improve upon the prior art techniques, particularly the solvent extraction technique, in order to reduce the cost of obtaining high quality petroleum-type normally liquid products from coal.

SUMMARY OF THE INVENTION

Therefore, it is an object of this invention to provide an improved process for the liquefaction of coal whereby valuable normally liquid hydrocarbons are obtained therefrom.

It is a specific object of this invention to provide an improved process for subjecting pulverized coal to liquefaction for the conversion thereof into valuable normally liquid hydrocarbons.

It is a particular object of this invention to provide an improved process for producing hydrogen-enriched hydrocarbonaceous products from coal in a facile and economical manner.

Therefore, in accordance with the practice of one embodiment of this invention, there is provided a process for the liquefaction of coal which comprises subjecting coal particles to electromagnetic wave energy having a wavelength of from about 0.001 to about 100 Å and subjecting the resulting coal particles to coal liquefaction conditions including a temperature from about 32° F. to about 900° F. and a pressure from one atmosphere to about 10,000 psig sufficient to convert at least about 50% by weight of the moisture and ash free (M.A.F.) coal into normally liquid products.

Another embodiment of this invention provides for the liquefaction of coal which comprises subjecting coal particles in the presence of a selective solvent to electromagnetic wave energy having wavelengths of from about 0.001 to about 100 Å and subjecting the resulting coal particles to coal liquefaction conditions including a temperature from about 32° F. to about 900° F. and a pressure from one atmosphere to about 10,000 psig sufficient to convert at least about 50% by weight of the M.A.F. coal into normally liquid products.

Yet another embodiment of this invention provides for the liquefaction of coal which comprises subjecting coal particles in the presence of a selective solvent to electromagnetic wave energy having wavelengths of from about 0.001 to about 100 Å at coal liquefaction conditions including a temperature from about 32° F. to about 900° F. and a pressure from one atmosphere to about 10,000 psig sufficient to convert at least about 50% by weight of the M.A.F. coal into normally liquid products.

DETAILED DESCRIPTION OF THE INVENTION

Thus, it is to be noted from the summary of the present invention hereinabove described that the benefits from the practice thereof are predicated on the use of electromagnetic wave energy having wavelengths of from about 0.001 to about 100 Å to convert solid particulate coal into normally liquid coal products. It is believed that one of the reasons the practice of this invention produces such a desirable result is that, for example, electromagnetic energy activates the indigenous volatile matter in the coal which begins to dissolve the coal and provides the nucleus for the formation of a solvent material to continue the conversion of solid coal into liquid products. Furthermore, as will be evident from the description presented herein, the use of electromagnetic energy permits the liquefaction of coal at significantly lower temperatures than normally utilized by the prior art and significantly reduces the time required to convert solid coal into liquid products.

Additional benefits may also accrue in the practice of this invention by utilizing a selective solvent, hydrogen gas, admixture of hydrogen gas and hydrogen sulfide, and/or a hydrogenation catalyst in the liquefaction zone.

The coal preferred for use in the practice of the present inventive process is of the bituminous type, such as Pittsburg Seam Coal. More preferably, however, the bituminous coal is a high volatile content coal having a volatile content greater than about 20% by weight of M.A.F. coal (moisture and ash-free coal) and, typically, from 25% to 35% by weight volatile content. Although the present invention will be described with reference to the conversion of bituminous coal to valuable normally liquid hydrocarbons, it is within the concept of the present invention to apply the inventive process to bituminous coal, sub-bituminous coal, lignite, and other solid carbonaceous materials of natural origin. For convenience, therefore, the term "coal" is intended to include all materials withing the class consisting of bituminous coal, sub-bituminous coal, lignite, and other solid carbonaceous materials of natural origin.

Apparatus for use in pulverizing the lump or coarse coal feed to the present invention may be of any type known to those skilled in the art. Conventional ball mills or rod mills may be used with satisfactory results. Preferably, the apparatus must be able to pulverize lump or coarse coal in the presence of significant quantities of liquid solvent without difficulty. Those skilled in the art are familiar with the kinds of apparatus for the crushing and grinding of coarse materials, so no detailed discussion of the apparatus need be presented herein. Preferably, the coarse coal usually having an average particle diameter in excess of 0.8 inch and, typically, from 0.25 to 2.0 inches, is processed through the crushing and grinding apparatus sufficient to reduce in size the average particle diameter to at least −8 Tyler screen size and, preferably, reduce to an average particle size of −14 Tyler screen size. As used herein, the term "Tyler screen" refers in all instances to the commercial Tyler Standard Screens. The correlation between Tyler screen mesh and average particle diameter is as follows:

| Tyler screen mesh: | Average diameter of particle, $D_{avg}$ in. |
|---|---|
| −8 + 10 | 0.0791 |
| −10 + 14 | 0.0555 |
| −14 + 20 | 0.0394 |
| −20 + 28 | 0.0280 |
| −28 + 35 | 0.0198 |
| −35 + 48 | 0.0140 |
| −48 + 65 | 0.0099 |
| −65 + 100 | 0.0077 |
| −100 + 150 | 0.00496 |
| −150 + 200 | 0.0035 |

The operation of the pulverization equipment is preferably performed so that the oversized material, that is, greater in size than the −8 Tyler screen size, be separated and returned to the apparatus for further pulverization. The utilization of the closed circuit technique is well known to those skilled in the art and is preferred in the practice of this invention. Unless otherwise stated, closed circuit operation of the pulverization equipment will be deemed inherent in the practice of this invention.

Following the size reduction step wherein the oversized solid materials have been separated from the effluent of the pulverization zone, the coal particles are then subjected to the process of the present invention for the substantial conversion of the coal into normally liquid hydrocarbonaceous products.

In accordance with this invention, the pulverized coal is subjected to electromagnetic wave energy.

Apparatus, equipment and other sources useful for generating the electromagnetic wave energy are standard and well known to those skilled in the art. Typically, for example, such equipment might include x-ray tubes and radioactive sources for transmitting the electromagnetic wave energy to the material to be treated. Since these items are conventional, those skilled in the art from the teachings presented herein will know how to accumulate and assemble the stock components necessary to generate the required electromagnetic wave energy and apply it to the coal in the manner described herein.

Operating conditions during the liquefaction step include a temperature from about 32° F. to about 900° F. and a pressure from about one atmosphere to about 10,000 psig sufficient to convert at least about 50% by weight of the moisture and ash free coal (M.A.F.) into normally liquid products.

In a preferred embodiment of this invention, a selective solvent is utilized as an integral part of the liquefaction process. In operation, the coal is admixed with the selective solvent either during the pulverization step previously described or in the liquefaction zone or in both instances.

Suitable solvents for use in the practice of the preferred embodiment of this invention are those of the hydrogen-donor type and are at least partially hydrogenated and include naphthalenic hydrocarbons. Other hydrocarbons, such as naphthalene, methylnaphthalene, etc. may also be used if added hydrogen gas is also used in the extraction zone. Preferably, the solvent is one which is in liquid phase at the recommended temperature and pressure for extraction. Mixtures of the hydrocarbons are generally employed as the solvent and, preferably, are derived from intermediate or final products obtained from subsequent processing following the practice of this invention. Typically, the solvent hydrocarbons or mixtures of hydrocarbons boil between about 500° F. and 1000° F. Examples of suitable solvents are tetrahydronaphthalene (Tetralin), Decalin, biphenyl, methylnaphthalene, dimethylnaphthalene, etc. Other types of solvents which may be added to the preferred solvents of this invention for special reasons include phenolic compounds, such as phenols, cresols, and xylenols. It is also to be recognized that in some cases it may be desirable during a subsequent separation step prior to the removal of the solvent from the liquid coal extract to add an anti-solvent, such as saturated paraffinic hydrocarbons like hexane, to aid in the precipitation of tarry and solid residue, e.g. ash, from the coal extract of the invention.

However, in the selection of a suitable solvent it must be recognized that the solvent must have the ability to transfer hydrogen to the pulverized coal during the extraction step. In other words, it is a requirement that in the absence of added hydrogen, the rich solvent leaving the extraction step having coal dissolved therein must have a reduced hydrogen content compared to the hydrogen content of the lean-solvent which is added to the extraction zone. In a still further preferred embodiment of this invention there is embodied the selective hydrogenation of the solvent during extraction in order to increase its hydrogen content so that hydrogen may be more easily transferred from the solvent to the coal during the solvent extraction operation.

The essence of the present invention is based on the discovery that the utilization of electromagnetic wave energy of the type described herein will clearly enhance the efficiency and effectiveness of the conversion of solid coal to liquid coal extract. Specifically, it was found that the time required for liquefaction was considerably reduced, the amount of solvent utilized in the preferred embodiment was significantly reduced and the temperature at which liquefaction was possible was significantly reduced. In fact, in some cases, depending upon the volatile content of the coal utilized as feed, it was found possible to eliminate the need for an added solvent.

For the preferred embodiment of the present invention, utilizing the presence of a selective solvent, the operating conditions for the liquefaction step include a temperature of from about 32° F. to about 900° F., a pressure from about 500 psig to about 10,000 psig, a solvent to coal ratio of from about 0.2 to about 10, and a residence time in the liquefaction zone from about 30 seconds to about 5 hours and, still more preferably, include the presence of hydrogen sufficient to dissolve coal such that a total in excess of about 50% by weight of the coal fed into the liquefaction zone has been liquefied into normally liquid products.

Since the purpose of the extraction zone is to substantially convert coal into liquid coal extract, it may be desirable to add a catalyst to the extraction zone. The catalyst may be conventional, may be homogenous or heterogenous and may be introduced into the pulverization zone and/or extraction zone in admixture with either the liquid solvent or with the solid coal. Those skilled in the art, from a knowledge of the characteristics of the coal, solvent, and of the properties desired for the end product, will know whether or not it may be desirable to use any or all of these features in the solvent extraction zone. If a catalyst is desired, conventional solid hydrogenation catalyst can be satisfactorily utilized, such as palladium on an alumina support or a cobalt-molybdate catalyst or any other hydrogenation catalyst known to those skilled in the art and applicable to the solvent-coal system environment maintained in the extraction zone including the use of a slurry-catalyst system.

Hydrogenation in the extraction zone, generally, accomplishes the following functions: transfer of hydrogen directly to coal molecules; transfer of hydrogen to hydrogen-donor molecules; transfer of hydrogen from hydrogen-donor molecules to coal molecules; transfer of lower molecular weight quenching agents; and various combinations of the above. The amount of hydrogen which may be added to the liquefaction zone can be varied over an extremely wide range. For example, hydrogen in an amount from 1,000 to 10,000 standard cubic feet of hydrogen per barrel of selective solvent and, typically, about 5,000 s.c.f./b. may be used with satisfactory results. Similarly, in the embodiment wherein no added solvent is utilized in the liquefaction zone, the amount of hydrogen may vary from 100 to 10,000 standard cubic feet per 100 pounds of of solid coal particles introduced into the liquefaction zone. By way of emphasis, as used herein, the term "liquefaction zone" or "extraction zone" is intended to include the pulverization step, the digestion step, or combined pulverization-digestion as is known to those skilled in the art.

After separation of the gaseous materials, including hydrogen, hydrogen sulfide, undissolved coal residue (e.g. ash) and catalyst, if any, from the total effluent of the extraction zone, the liquid coal extract is passed into conventional recovery facilities wherein valuable liquid hydrocarbons are recovered. Typically, these recovery facilities comprise fractionation columns for the separation therein of the liquid coal extract into products such as normally gaseous hydrocarbons, relatively light hydrocarbons comprising essentially middle oil, relatively heavy hydrocarbons comprising materials suitable for use as a coal solvent and a bottoms fraction comprising residue material which is suitable for fuel. In essence, therefore, the valuable liquid hydrocarbons recovered from the liquid coal extract include, for example, gasoline boiling range products and/or chemicals, aromatic hydrocarbon-containing fractions, heavy fuel oil fractions, and the like, the utility of which is well known to those skilled in the art.

The extraction of coal by means of a selective solvent is by definition at least a partial conversion of the coal since not only is the coal reacted with hydrogen which is transferred from the solvent, but is also reacted with the hydrogen which is added during the extraction step. In addition, there is also a solution phenomenon which actually dissolves the coal which has accepted the hydrogen into the solvent. Therefore, as used herein, the terms "liquid coal extract" and "liquid coal fraction" or other words of similar import are intended to include the liquid product which is obtained from the liquefaction of the coal utilizing electromagnetic wave energy, preferably with added solvent, and generally has been described on the basis of being "solvent free" even though a portion of the extract comprises hydrocarbons suitable for use as the solvent.

The practice of the present invention is preferably performed under conditions which increase the kinetics of the reaction while maintaining the components therein in primarily liquid phase; although, in some cases, it may be desirable to practice this invention in the presence of a vaporized solvent and hydrogen gas.

The following examples are presented for illustration and are not intended as an undue limitation on the generally broad scope of the invention as set out in the appended claims. Example I describes the investigation of the use of radiation to convert petroleum asphaltenes to liquid hydrocarbons. Example II describes the use of radiation to convert coal to more valuable, liquid hydrocarbons and to particularly point out the advantages derived therefrom. The latter example is a preferred embodiment of the present invention.

EXAMPLE I

Crude oils and other heavy hydrocarbon fractions generally contain large quantities of pentane-insoluble materials present in the form of a dispersion which are difficult to effectively convert with conventional hydrorefining catalysts. These pentane-insoluble materials, described as asphaltenes, are carbonaceous materials considered as coke precursors having a strong tendency to become immediately deposited within a hydrocarbon conversion zone and upon catalytic surfaces as a gummy hydrocarbonaceous residue. The asphaltenes are also thought to contain the bulk of the difficultly removable metal contaminants as well as a considerable portion of the undesirable nitrogenous and sulfurous compounds.

A sample of petroleum asphaltenes was prepared by dilution of a topped Boscan crude with isopentane at ambient temperature and pressure. After dilution, the asphaltenes were separated by centrifugation and washed with fresh isopentane. A 150 g. sample of the recovered asphaltenes was placed into a six inch watch glass and positioned 36 inches from an Isovolt 400 industrial x-ray generator for a 55 minute exposure at a 3.5 kilowatt power input. A blank sample was treated in the same manner except that no radiation exposure was used.

A processibility study was performed on each of the asphaltene samples wherein a 100 g. sample of asphaltenes was admixed with 100 g. of a heavy hydrogenated petroleum hydrocarbon solvent and 15 g. of vanadium tetrasulfide. The resulting admixture was charged to an autoclave and reacted for one hour at 735° F., and 2000 psig in a 10% hydrogen sulfide/90% hydrogen atmosphere. The resulting product was cooled and washed from the autoclave with toluene. The toluene soluble product was then charged to a vacuum rotary evaporator to recover a toluene free product. The solvent separation analysis of the autoclave test product is presented in Table 1.

Detailed analyses were made of the asphaltene charge stock and the toluene soluble product. In this case, each sample was separated into three portions. A n-hexane elution removes the lightest fraction. The ether elution removes the heavier fraction which is usually labeled the resin fraction. Finally, the chloroform elution removes the heaviest fraction usually referred to as the asphaltenes. A summary of the elution yields and analyses is presented in Table 2.

TABLE 1

| SOLVENT SEPARATION ANALYSIS - AUTOCLAVE TEST PRODUCT | BLANK | IRRADIATED |
|---|---|---|
| TOLUENE SOLUBLE (%) | 94.8 | 94.2 |
| Isopentane Soluble | | |
| % of sample | 81.1 | 75.1 |
| % carbon | 85.8 | 85.4 |
| % hydrogen | 10.9 | 11.0 |
| % sulfur | 3.96 | 4.26 |
| % nitrogen | 0.58 | 0.59 |
| % conradson carbon | 7.03 | 6.65 |
| % heptane insolubles | 0.02 | 0.22 |
| Isopentane Insoluble | | |

TABLE 1-continued

| SOLVENT SEPARATION ANALYSIS - AUTOCLAVE TEST PRODUCT | BLANK | IRRADIATED |
|---|---|---|
| % of sample | 18.9 | 24.9 |
| % carbon | 86.6 | 83.6 |
| % hydrogen | 9.07 | 8.68 |
| % heptane insolubles | 42.3 | 39.7 |
| TOLUENE INSOLUBLE (%) | | |
| % carbon | 13.1 | 12.5 |
| % hydrogen | 1.90 | 1.90 |
| APPARENT CONVERSION OF ISOPENTANE INSOLUBLE MATERIAL (%) | 62.2 | 50.0 |

TABLE 2

| SUMMARY OF SEPARATION ANALYSIS | BLANK | | IRRADIATED | |
|---|---|---|---|---|
| | Asphaltene Charge Stock | Toluene Soluble Fraction | Asphaltene Charge Stock | Toluene Soluble Fraction |
| n-Hexane Elution | | | | |
| % of sample* | 8.80 | 55.3 | 7.40 | 53.0 |
| % carbon | 83.03 | 83.7 | 83.85 | 83.8 |
| % hydrogen | 9.58 | 11.0 | 11.63 | 11.6 |
| Ether Elution | | | | |
| % of sample* | 36.8 | 40.1 | 30.8 | 41.1 |
| % carbon | 80.32 | 82.18 | 79.38 | 81.65 |
| % hydrogen | 9.72 | 9.77 | 8.68 | 9.32 |
| % oxygen | 2.58 | 2.65 | — | — |
| % nitrogen | 1.36 | 2.44 | — | — |
| % sulfur | 6.23 | 4.04 | — | — |
| molecular weight | 924 | 733 | 1265 | 994 |
| Chloroform Elution | | | | |
| % of sample* | 54.4 | 4.57 | 61.7 | 5.97 |
| % carbon | 80.5 | 76.8 | 79.4 | — |
| % hydrogen | 7.80 | 7.04 | 8.68 | — |
| % oxygen | 2.36 | 3.20 | 3.94 | 3.13 |
| % nitrogen | 3.63 | 1.40 | — | — |
| % sulfur | 6.90 | 5.03 | 5.10 | 4.86 |
| molecular weight | 7760 | 7350 | 6120 | 15700 |

*Normalized to 100%.

This analysis shows an increase in the chloroform eluted fraction after irradiation. It is also noted that the molecular weight of the ether fraction was increased by irradiation. Furthermore, from the experimental results, it is estimated that the irradiated sample of petroleum asphaltenes reacted at a rate of about 30% lower than the blank sample.

EXAMPLE II

A supply of Illinois No. 6 coal was obtained and crushed to a finely powdered state. The analysis of this coal is presented in Table 3. A 100 g. sample of the powdered coal was placed into a six inch watch glass and positioned 36 inches from an Isovolt 400 industrial x-ray generator for a 55 minute exposure at a 3.5 kilowatt power input. A blank sample was treated in the same manner except that no radiation was used.

Each of the one hundred gram samples was admixed with 150 g. of petroleum hydrocarbon solvent. The analysis of this solvent is presented in Table 4. Each of the resulting admixtures of coal and petroleum hydrocarbon solvent was charged to an autoclave and reacted for one hour at 735° F. and 2000 psig in a hydrogen atmosphere.

TABLE 3

| ANALYSIS OF ILLINOIS NO. 6 COAL | |
|---|---|
| Carbon, % | 67.21 |
| Hydrogen, % | 5.64 |

TABLE 3-continued

| ANALYSIS OF ILLINOIS NO. 6 COAL | |
|---|---|
| Oxygen, % | 12.7 |
| Sulfur, % | 3.0 |
| Nitrogen, % | 1.2 |
| Moisture, % | 1.0 |
| Ash, % | 7.9 |

TABLE 4

| ANALYSIS OF SOLVENT USED FOR COAL PROCESSABILTY AUTOCLAVE TEST | |
|---|---|
| % Carbon | 91.09 |
| % Hydrogen | 8.43 |
| ppm Oxygen | 1014 |
| % Sulfur | 1.55 |
| % Nitrogrn | 0.212 |
| % Toluene Insolubles | <0.01 |
| % Heptane Insolubles | 0.29 |

The resulting product was cooled and washed from the autoclave with toluene. The toluene soluble product was then charged to a vacuum rotary evaporator to recover a toluene free product. A summary of the solvent separation analysis is presented in Table 5.

TABLE 5

| SOLVENT SEPARATION ANALYSIS - AUTOCLAVE TEST PRODUCT | BLANK* | IRRADIATED* |
|---|---|---|
| TOLUENE SOLUBLE (%) | 78.7 | 85.3 |
| Isopentane Soluble | | |
| % of sample | 66.4 | 74 |
| % carbon | 89.19 | 88.25 |
| % hydrogen | 8.45 | 8.65 |
| % sulfur | 1.55 | 1.48 |
| % nitrogen | 0.20 | 0.25 |
| % conradson carbon | 0.53 | 1.03 |
| % heptane insolubles | 0.10 | 0.09 |
| Isopentane Insoluble | | |
| % of sample | 33.6 | 26 |
| % carbon | 85.02 | 85.93 |
| % hydrogen | 6.95 | 7.43 |
| % heptane insolubles | 56.8 | 70.4 |
| TOLUENE INSOLUBLES (%) | 9.79 | 7.72 |
| % catbon | 57.91 | 51.38 |
| % hydrogen | 4.58 | 3.78 |
| WATER (%) | 1.60 | 3.92 |

*Includes the heavy solvent used in the autoclave test.

From the data presented in Table 5, the conversion of coal to toluene soluble and isopentane soluble products was enhanced by x-ray pretreatment. Of particular note is the increase in water yield for the irradiated sample. This suggests that the mode of beneficiation might involve oxygen cleavage but we do not wish to be limited by any such hypothesis. Although the kinetics for this process are not known, it is estimated that conversion of the irradiated coal sample is enhanced by about 15% for producing a toluene soluble product and about 145% for forming higher quality isopentane soluble product compared with the unradiated coal sample. Even though an estimate is used, the increase in conversion represents a significant rate enhancement.

The foregoing specification, and particularly the examples, indicates the method by which the present invention is effected, and the benefits afforded through the utilization thereof.

We claim as our invention:

1. A process for the liquefaction of coal which comprises:

(a) subjecting coal particles to electromagnetic wave energy artificially externally supplied and having wavelengths of from about 0.001 to about 100 Å; and (b) subjecting the resulting coal particles to coal liquefaction conditions including a temperature from about 32° F. to about 900° F. and a pressure from one atmosphere to about 10,000 psig sufficient to convert at least about 50% by weight of the M.A.F. coal into normally liquid products.

2. The process of claim 1 wherein said conditions include the presence of added hydrogen gas.

3. The process of claim 1 wherein said conditions include the presence of an added admixture of hydrogen and hydrogen sulfide gas.

4. The process according to claim 1 wherein said coal comprises high volatile content bituminous coal having a volatile content greater than about 20% by weight of the M.A.F. coal.

5. The process of claim 1 wherein said conditions include the presence of a selective solvent.

6. The process of claim 5 wherein said conditions include the presence of from about 500 to about 10,000 standard cubic feet of added hydrogen per barrel of solvent, a selective solvent to coal ratio of from about 0.2 to about 10 and a residence time of from about 30 seconds to about 5 hours.

7. A process for the liquefaction of coal which comprises:

(a) subjecting coal particles in the presence of a selective solvent to electromagnetic wave energy artificially externally supplied and having wavelengths of from about 0.001 to about 100 Å; and (b) subjecting the resulting coal particles to coal liquefaction conditions including a temperature from about 32° F. to about 900° F. and a pressure from one atmosphere to about 10,000 psig sufficient to convert at least about 50% by weight of the M.A.F. coal into normally liquid products.

8. The process of claim 7 wherein said conditions include the presence of added hydrogen gas.

9. The process of claim 7 wherein said conditions include the presence of an added admixture of hydrogen and hydrogen sulfide gas.

10. The process according to claim 7 wherein said coal comprises high volatile content bituminous coal having a volatile content greater than about 20% by weight of the M.A.F. coal.

11. The process of claim 7 wherein said conditions include the presence of from about 500 to about 10,000 standard cubic feet of added hydrogen per barrel of solvent, a selective solvent to coal ratio of from about 0.2 to about 10 and a residence time of from about 30 seconds to about 5 hours.

12. A process for the liquefaction of coal which comprises subjecting coal particles in the presence of a selective solvent to electromagnetic wave energy artificially externally supplied having wavelengths of from about 0.001 to about 100 Å at coal liquefaction conditions including a temperature from about 32° F. to about 900° F. and a pressure from one atmosphere to about 10,000 psig sufficient to convert at least about 50% by weight of the M.A.F. coal into normally liquid products.

13. The process of claim 12 wherein said conditions include the presence of added hydrogen gas.

14. The process of claim 12 wherein said conditions include the presence of an added admixture of hydrogen and hydrogen sulfide gas.

15. The process of claim 12 wherein said coal comprises high volatile content bituminous coal having a volatile content greater than about 20% by weight of the M.A.F. coal.

16. The process of claim 12 wherein said conditions include the presence of from about 500 to about 10,000 standard cubic feet of added hydrogen per barrel of solvent, a selective solvent to coal ratio of from about 0.2 to about 10 and a residence time of from about 30 seconds to about 5 hours.

* * * * *